US005547157A

United States Patent [19]

Hsiao

[11] Patent Number: 5,547,157

[45] Date of Patent: Aug. 20, 1996

[54] DISPLAY APPARATUS FOR SUPPORTING IN-LINE SKATES

[76] Inventor: Louis Hsiao, 765 A Loma Verde Ave., Palo Alto, Calif. 94303

[21] Appl. No.: 268,310

[22] Filed: Jun. 30, 1994

[51] Int. Cl.[6] ..... A63C 3/12

[52] U.S. Cl. ..... 248/309.1; 211/35; 211/37; 280/825

[58] Field of Search ..... 248/200, 309.1, 248/126; 211/34, 35, 37; 280/809, 811, 814, 825; 294/162–169

[56] References Cited

U.S. PATENT DOCUMENTS

| | | | |
|---|---|---|---|
| 928,964 | 7/1909 | Hall | 211/34 |
| 1,380,376 | 6/1921 | Hardcastle | 211/35 |
| 1,949,017 | 2/1934 | Knupp | 211/35 |
| 2,353,809 | 7/1944 | Carson | 294/165 |
| 2,383,651 | 8/1945 | Hill | 211/34 X |
| 2,603,393 | 7/1952 | Oblusteel | 211/34 X |
| 3,861,697 | 1/1975 | Dolce | 280/825 |
| 4,326,746 | 4/1982 | Grihalva | 294/162 X |
| 5,120,012 | 6/1992 | Rosenau | 248/309.1 X |
| 5,269,580 | 12/1993 | Hsiao . | |

FOREIGN PATENT DOCUMENTS

| | | | |
|---|---|---|---|
| 253736 | 4/1967 | Austria | 211/35 |
| 2065834 | 10/1993 | Canada | 280/825 |

OTHER PUBLICATIONS

Wire Accessories for Slatwall and Gridwall, 1993 Catalog, p. 16.

FMO Products, Inc., Advertising Circular (Date unknown).

*Primary Examiner*—Ramon O. Ramirez
*Assistant Examiner*—Derek J. Berger
*Attorney, Agent, or Firm*—Flehr, Hohbach, Test, Albritton & Herbert

[57] ABSTRACT

A display apparatus for supporting an in-line skate. The display apparatus includes a support member and a retainer positioned and dimensioned to engage opposite sides of at least one of the rollers to retain the skate in a substantially upright position. The support member optionally has a slot shaped to receive at least one of the rollers of the skate and a retainer adjacent the slot.

24 Claims, 6 Drawing Sheets

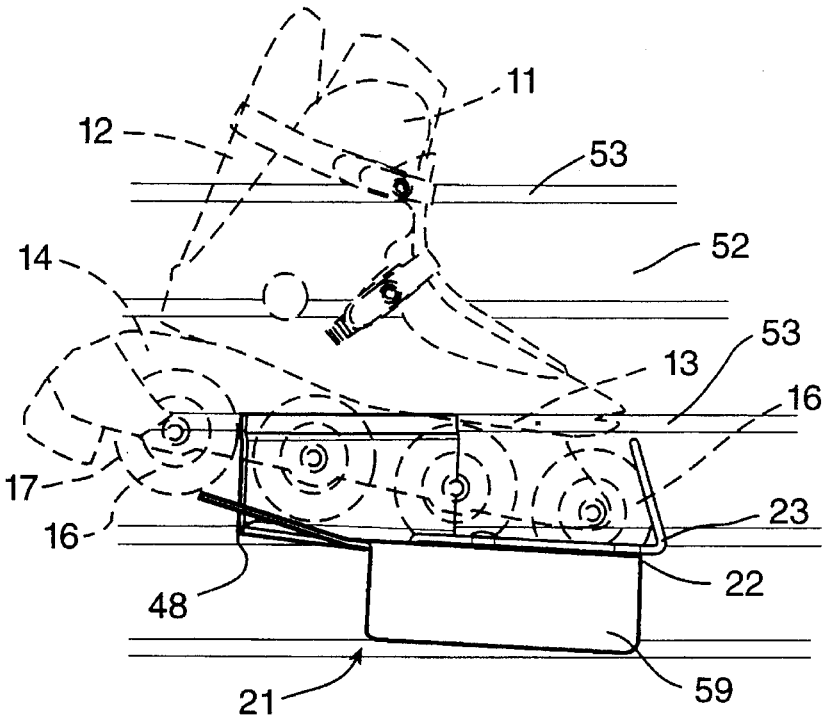
FIG.__ 1
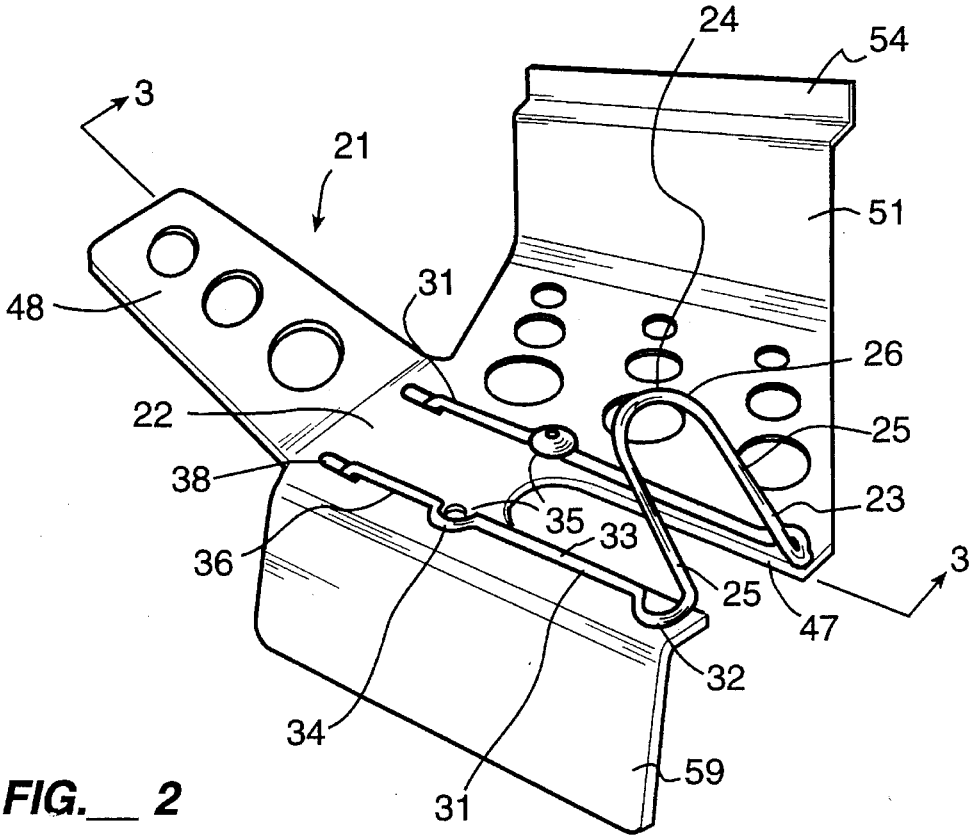
FIG.__ 2

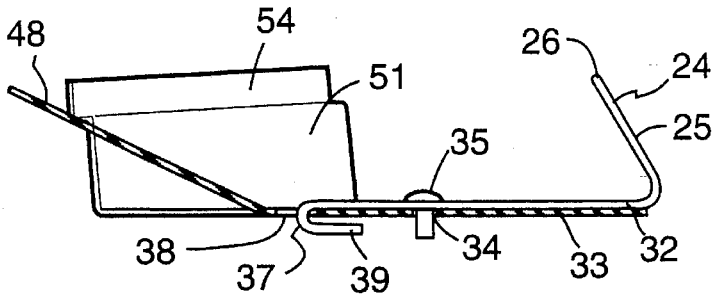
FIG.__ 3
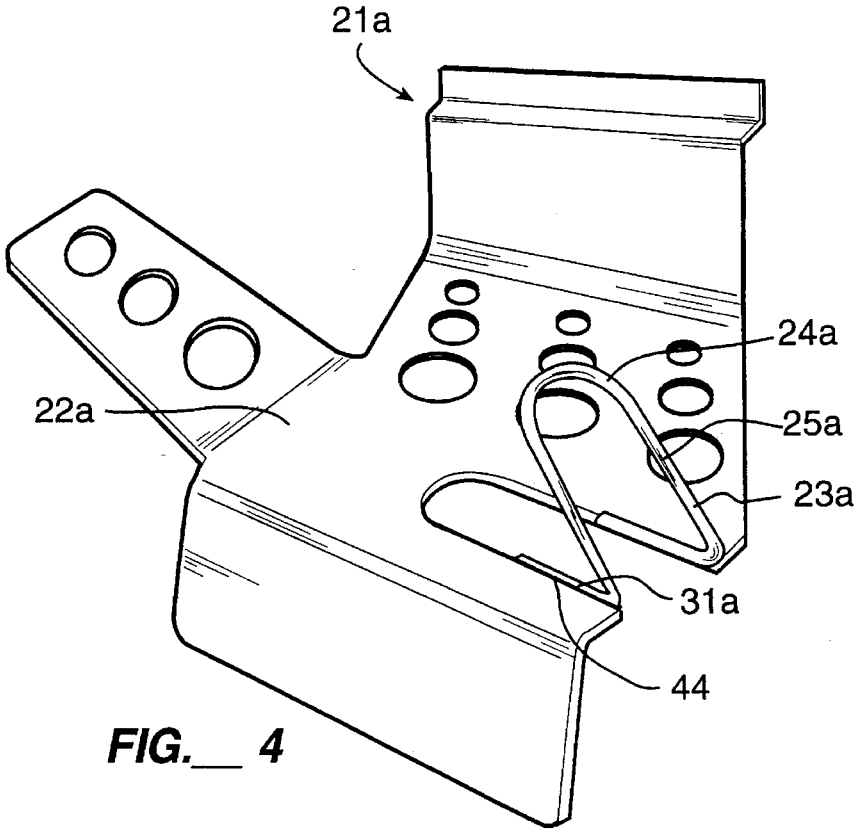
FIG.__ 4
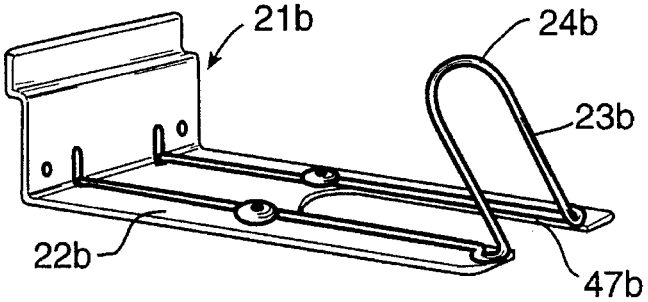
FIG.__ 5

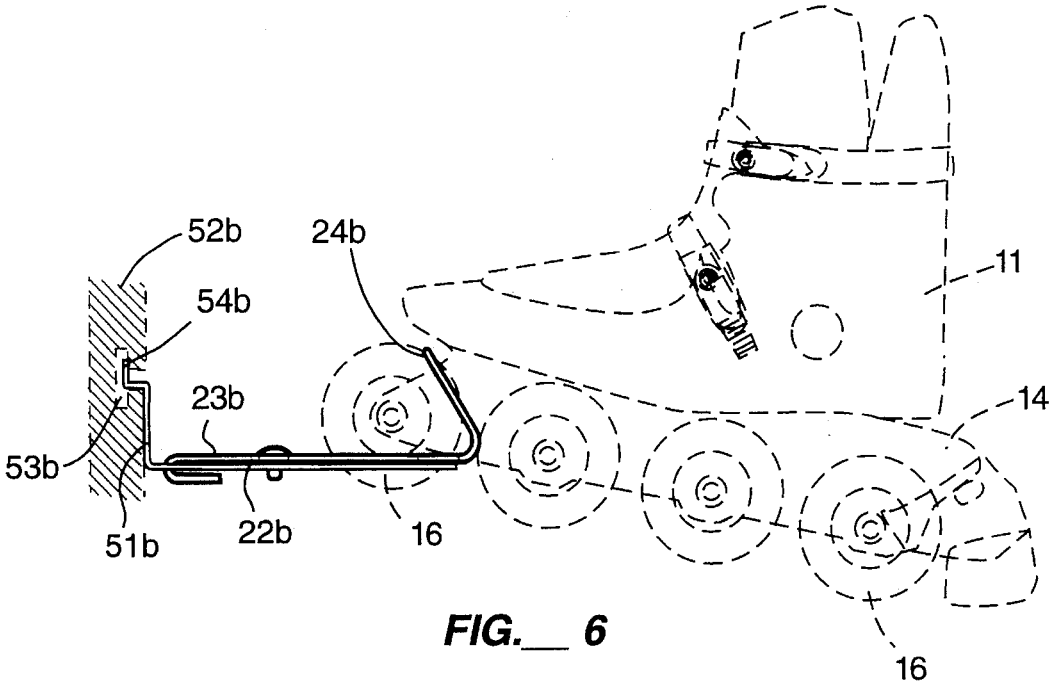
FIG.__ 6
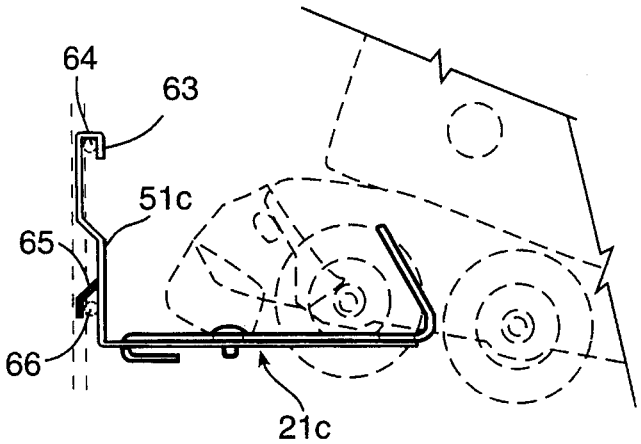
FIG.__ 7
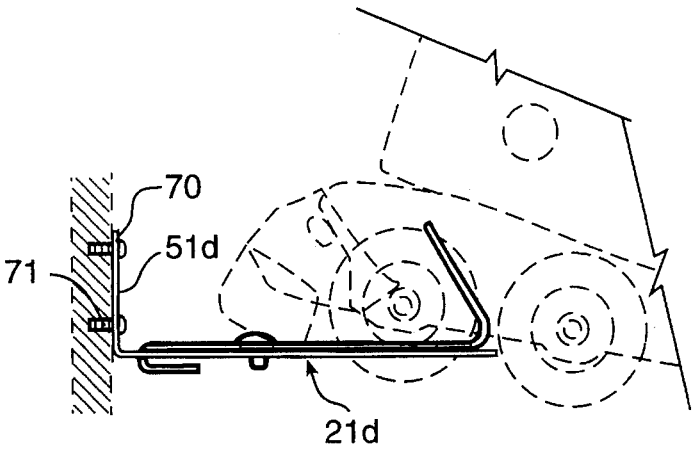
FIG.__ 8

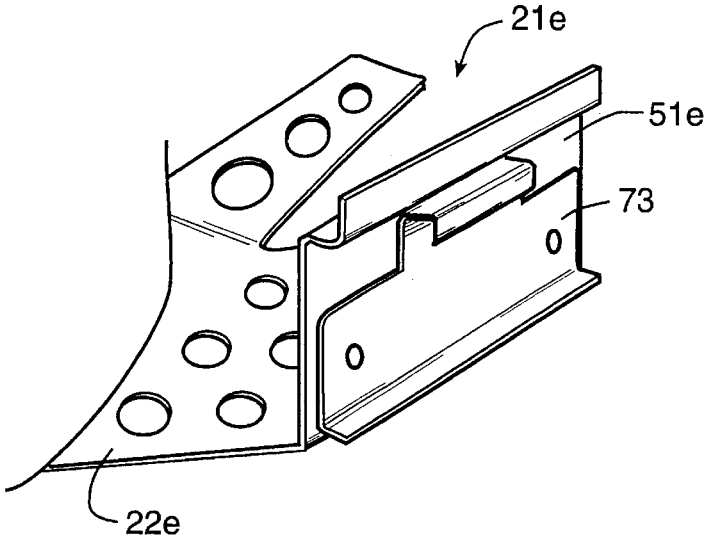
FIG.__ 9
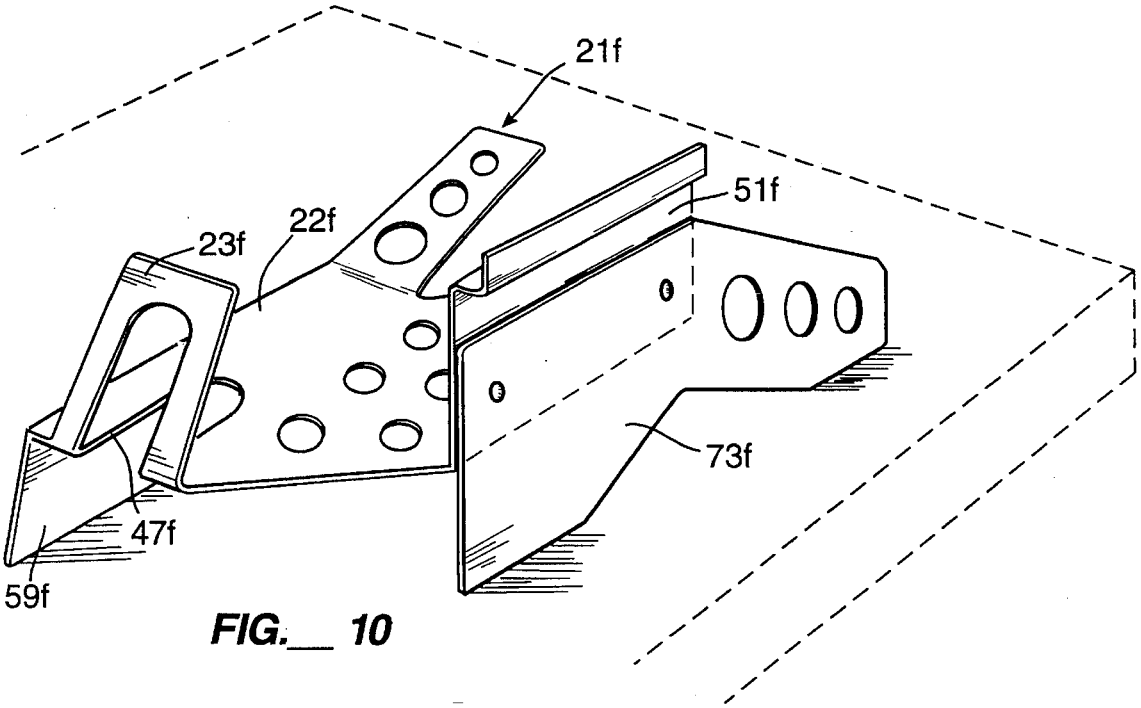
FIG.__ 10

FIG.__11
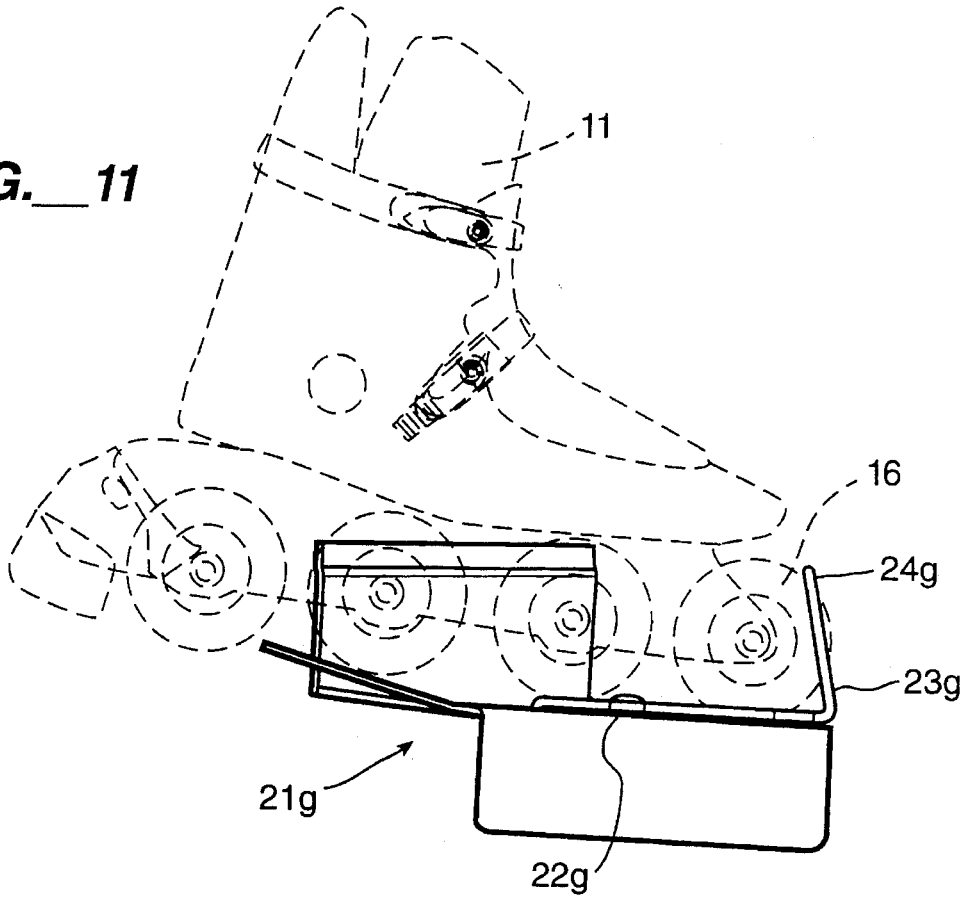
FIG.__12
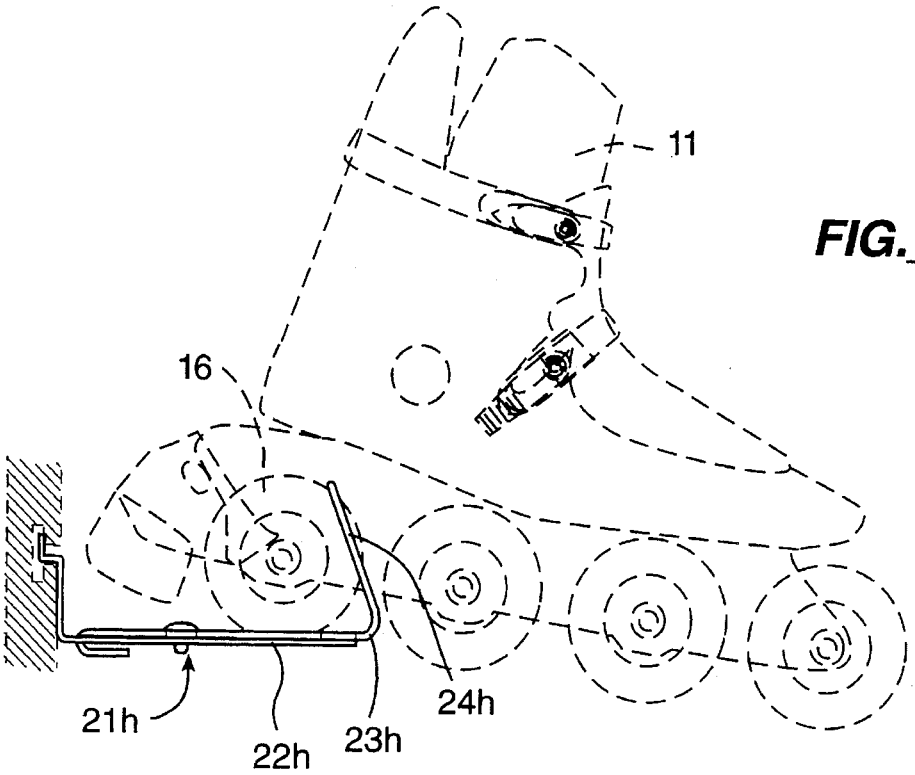

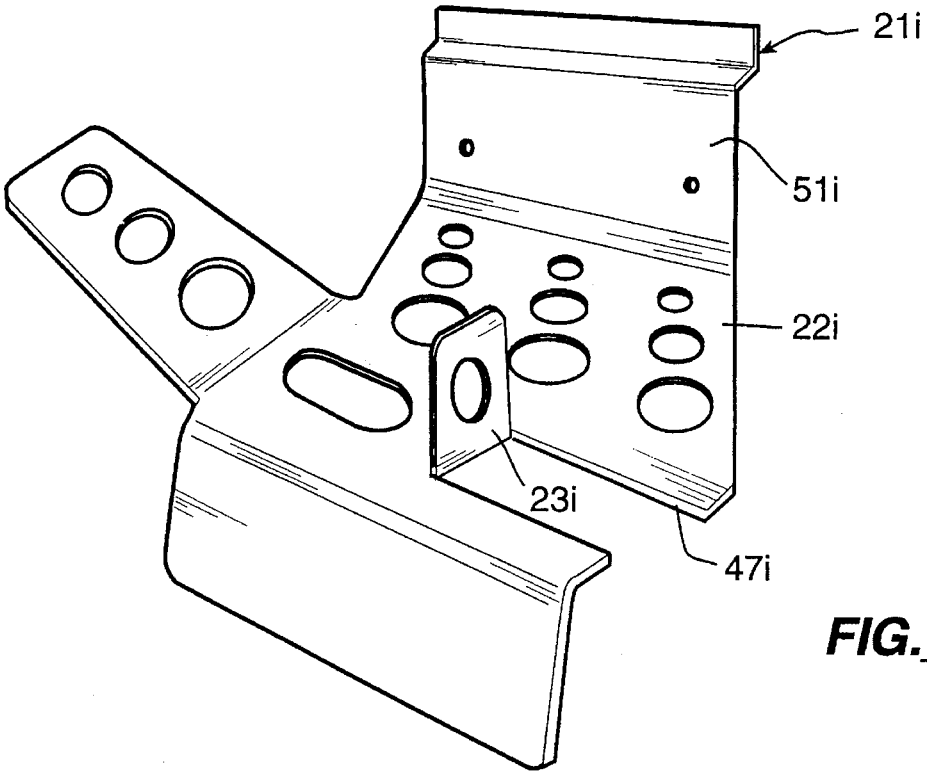
FIG.__13
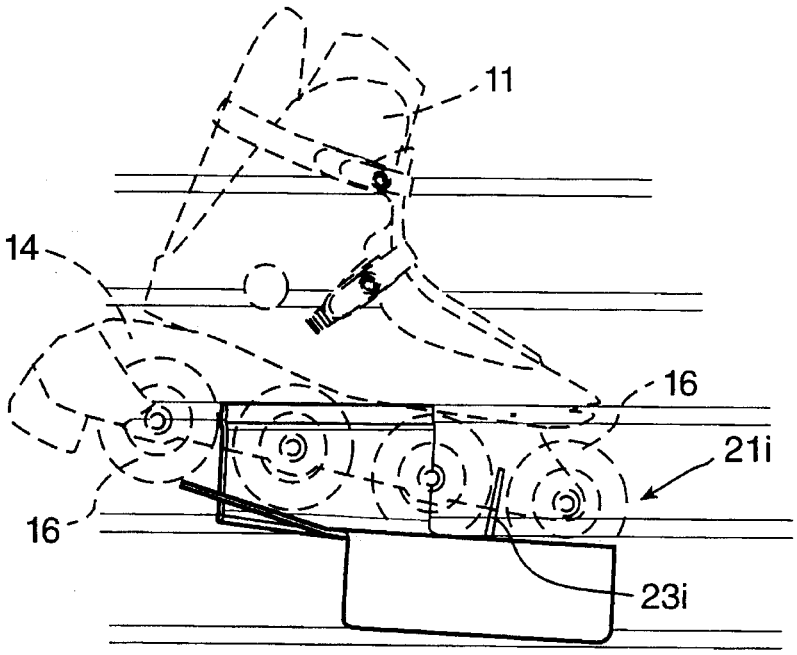
FIG.__14

DISPLAY APPARATUS FOR SUPPORTING IN-LINE SKATES

BACKGROUND OF THE INVENTION

1. Field of the Invention

This invention relates to a new and improved apparatus for supporting in-line skates and, more particularly, to a display apparatus for supporting in-line skates in an aesthetically appealing fashion.

2. Prior Art

Merchants typically prefer to display skates and the like in an upright position. However, in-line skates are inherently unstable in an upright position because of the in-line configuration of the rollers on the bottom of the skates. One technique for displaying in-line skates is to position the skate on display rods or a display shelf with the boot propped against the wall. Such a technique allows the consumer to remove and inspect the skate, but is somewhat precarious as the skate may fall from the shelf causing potential damage to the skate or other merchandise and may potentially injure individuals standing near the shelf. Another means for displaying the skate is to secure the skate to a wall or a display apparatus. However, this method does not allow a consumer to freely handle or inspect the skate.

U.S. Pat. No. 5,269,580 discloses a device for carrying in-line skates. The carrying device has a pair of pockets shaped to receive one of the rollers on the skate. A wire loop extends around a portion of the roller and a retainer engages the roller and the edge of the boot to hold the roller in the pocket. If desired, the carrying device may be hung on a hook or the like on a wall to store the skates.

This invention provides a new and improved display apparatus for supporting in-line skates. The display apparatus securely retains the in-line skates in an upright position, while allowing the skates to be easily and conveniently positioned in and removed from the display apparatus.

SUMMARY OF THE INVENTION

The display apparatus of the present invention is particularly suitable for securely retaining an in-line skate in a substantially upright position. In general, the in-line skate includes a boot, a channel-shaped frame depending from the boot and a plurality of rollers rotatably mounted at spaced intervals to the frame with the rollers positioned in the channel and extending below the frame. The display apparatus includes a support member and a retainer having a pair of retaining arms extending upwardly from the support member. The retaining arms are positioned to engage opposite sides of at least one of the rollers or the interior of the channel-shaped frame to retain the skate on the display and support the skate in a substantially upright position.

In one modification, the support member is formed with an elongated slot adjacent the retainer. At least one of the rollers on the skate is seated in the slot. The support member provides lateral support for the roller which, together with the support provided by the retainer, detachably secures the skate to the display and supports the skate in an upright position.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 1 is an elevational view of a display apparatus mounted to a wall and supporting an in-line skate.

FIG. 2 is a perspective view of the display apparatus of FIG. 1.

FIG. 3 is a sectional view taken substantially along the line 3—3 in FIG. 2.

FIG. 4 is a perspective view of a modified display apparatus.

FIG. 5 is a perspective view of another modification of a display apparatus.

FIG. 6 is an elevational view of the display apparatus of FIG. 5, shown mounted to a wall.

FIGS. 7 and 8 side elevational views, partially broken away, of modifications of the display apparatus of FIG. 5.

FIG. 9 is a rear perspective view, partially broken away, of another modified display apparatus.

FIG. 10 is a rear perspective view, partially broken away, of still another modified display apparatus.

FIG. 11 is an elevational view of a modified display apparatus.

FIG. 12 is an elevational view of another modified display apparatus.

FIG. 13 is a perspective view of still another modification of a display apparatus.

FIG. 14 is a front elevational view of the display apparatus of FIG. 13, shown supporting a skate.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

An example of an in-line skate 11 is partially shown in the accompanying drawings. The skate 11 has a boot 12 formed with a sole 13 and an inverted, channel shaped frame 14 secured to the sole 13. The frame 14 supports a plurality of rollers 16 (here shown as four in number) on axles 17 so that only the lower portions of the rollers 16 extend below the frame 14. Due to the elliptical shape and in-line configuration of the rollers 16, the skate 11 is inherently unstable in an upright position. The display apparatus 21 of the present invention supports and displays in-line skates or the like in a substantially upright position.

As shown in FIGS. 1–3, the display apparatus 21 has a horizontally extending support plate 22 for supporting an in-line skate 11. A roller retainer 23 having a U-shaped loop 24 is mounted to the support plate 22 for supporting the skate 11 in an upright position and securely holding the skate on the display 21. The loop 24 of the retainer 23 is defined by two inclined arms 25 which extend upwardly from the support plate and a connecting portion 26 extending between the inclined arms 25. When a skate 11 is supported on the display apparatus 21, the inclined arms 25 of retainer 23 are positioned on opposite sides of one of the rollers 16 and the connecting portion 26 extends across and engages the upper portion of the roller. The inclined arms 25 of the retainer 23 engage the roller 16 to substantially prevent pivotal movement of the skate relative to the support plate 22 to retain the skate in a stable, upright position. The engagement between the loop 24 and the roller 16 also securely retains the skate on the display 21, providing protection against the in-line skate falling from the display and potentially damaging the skate 11, other merchandise or injuring an individual standing near the display.

The front roller 16 is preferably engaged by the loop 24 as shown in FIG. 1. However, the orientation of the skate may be reversed to position the rear roller in the skate or, if desired, the retainer 23 may engage one of the inner rollers provided the loop 24 is dimensioned to fit within the channel of the frame 14. Moreover, the connecting portion 26 may be omitted and the inclined arms 25 of the retainer 23 may be positioned between the rollers 16 where the inclined arms engage the frame 14 of the skate and retain the skate in an upright position.

In the modification shown in FIGS. 1–3, the roller retainer 23 has two horizontal legs 31 extending rearwardly from the inclined arms 25 of the loop 24 for securing the retainer to the support plate 22. Starting from the inclined arms 25, the legs 31 are formed with outward bends 32 proximate the inclined arms 25 to provide reinforcement for the U-shaped loop 24. Horizontal stretches 33 extend rearwardly from the bends 32 and terminate in outward bends 34 formed to receive fasteners 35. The fasteners 35 extend through the bends 34 and the support plate to securely mount the retainer 23 to the plate 22. Horizontal stretches 36 extend rearwardly from the bends 34 and terminate in 180° bends 37 which pass through slits 38 formed in the support plate. The ends 39 of the horizontal legs 31 are located below the horizontal stretches 36 and the support plate 22. The retainer 23 is securely anchored to the support plate 22 by the hooked ends 38 and the engagement between the fasteners 35 and bends 34.

In the illustrated modifications, the retainer 23 is a provided by a wire member secured to the support plate 22. However, it is to be understood that the retainer may be integrally formed with the support member 22 if desired. As shown in FIGS. 1–3, the retainer 23 is mounted to the support plate 22 by the fasteners 34 and the hooked ends 39 of the horizontal legs. However, it is to be understood that the roller retainer 23 may be secured to the support plate 22 using any suitable mounting means. For example, FIG. 4 shows a modified display **21*a* in which the retainer 23*a* is secured to the support plate 22*a* by a weld 44. The retainer 23*a* has horizontal legs 31*a* extending rearwardly from the inclined arms 25*a* of the loop 24*a*. The weld 44 affixes the horizontal legs 31*a* of the retainer to the support plate 22*a*. The legs 31*a* and the weld 44 are of sufficient length to securely adhere the retainer 23*a* to the support plate 22*a*. The retainer 23*a* may be affixed to the upper surface of the support plate as shown. Alternatively, the horizontal legs 31*a* may be welded to other surfaces of the support plate 22*a***.

Directing attention to FIGS. 1–3, support plate 22 is formed with an elongated slot 47 which is shaped to receive the lower portion of at least one of the rollers 16. As shown particularly in FIG. 1, the lower portion of the roller 16 is seated in the slot 47 when the skate 11 is positioned on the support plate 22. The plate 22 cooperates with the retainer 23 to support the skate in an upright position by providing lateral support for the roller 16. With the slot 47, the lateral force exerted on the display 21 by the skate is applied to both the support plate 22 and the retainer 23. The slot 47 also ensures that the in-line skate is securely retained on the display 21. The slot 47 may be shaped to receive one or more of the rollers 16. As shown in FIG. 1, the lower portion of the two front rollers fit within the slot.

The support plate 22 is shaped so that the center of gravity of the in-line skate is located above the support plate, increasing the stability of the skate 11 on the display 21. As shown particularly in FIGS. 1 and 3, the support plate 22 has an upward slanted portion 48 opposite the elongated slot 47 to retain the in-line skate 11 at an angle relative to the horizontal plane, positioning the center of gravity of the skate above the support plate. The inclined orientation of the in-line skate urges the skate 11 forward against the retainer 23, ensuring that the roller 16 securely engages the loop 24 of the retainer and the slot 47 in the support bracket. The slanted portion 48 facilitates placement of the skate 11 on the display by directing the roller 16 into the elongated slot 47. Supporting the skate 11 in the inclined orientation shown in FIG. 1 also enhances the aesthetic appearance of the displayed skate.

The display 21 has a mounting bracket 51 provided along one edge of the support plate 22 for attaching the display to a wall. The mounting bracket 51 may be integrally formed with the support plate 22 as shown or the mounting bracket may be mounted to the support plate using suitable securement means. The configuration of the mounting bracket may be tailored to match the style of wall available for displaying the merchandise. As shown in FIG. 1, the wall 52 is formed with a plurality of horizontally extending slots 53. The distal end of the mounting bracket 51 terminates in an L-shaped flange 54 shaped to engage the slots 53 in the wall. By inserted the L-shaped flange 54 into a selected slot 53, the display apparatus 21 may be conveniently mounted to the wall at the desired location. Although not shown, screws or other fastening means may be inserted through apertures formed in the bracket 51 to further secure the display apparatus 21 to the wall.

As shown in FIGS. 2–3, the mounting bracket 51 is offset from and positioned at an angle relative to the retainer 23 so that the display 21 supports the skate 11 at an angle of approximately 45° relative to the plane of the wall. Some merchants prefer to display the in-line skates at such an angle to aesthetically enhance the appearance of the entire display and emphasize the side view of the skate. The placement of the mounting bracket 51 relative to the retainer 23 may be adjusted to achieve the desired orientation of the skate relative to the wall. The support bracket 22 and retainer 23 may also be configured to support the skate 11 parallel to the wall. The display 21 optionally includes a flap 59 depending from the support plate 22. The flap 59 may be used to display information about the skate such as the model, the manufacturer, important features of the skate, the selling price and the like.

A modified display apparatus **21*b* is shown in FIGS. 5 and 6. The display 21*b* includes a retainer 23*b* mounted to a support plate 22*b*. A mounting bracket 51*b* is used to mount the display with the support bracket 22*b* perpendicular to the wall. The skate 11 is suspended from the plate 22*b* with one of the rollers 16 positioned in the slot 47*b* in the support plate and engaged by the loop 24*b* of the retainer. As shown in FIG. 6, the loop 24*b* is dimensioned to fit within the channel of the frame 14 to engage the upper portion of the roller 16. The retainer 23*b* and the lateral support provided by the support plate 22*b* support the skate 11 in a substantially upright orientation. The skate 11 may be positioned with either the front or back roller 16 seated in slot 47*b* and engaged by loop 24*b* of the retainer or, if desired, the length of the elongated slot 47*b* may be increased to receive more than one roller 16**.

As shown in FIG. 6, the mounting bracket 51*b* has an L-shaped flange 54*b* shaped to engage the T-shaped slots 53*b* in the wall 52*b*. As mentioned above, the mounting bracket may be tailored to match the style of wall available for displaying the merchandise. FIGS. 7 and 8 shows two modifications of a mounting bracket. The mounting bracket 51*c* shown in FIG. 7 is formed with an inturned flange 63 at the upper end of the bracket 51*c* shaped to engage a first mounting rod 64. A downward slanted flange 65 extends from the rear surface of the mounting bracket 51*c* and engages a second mounting rod 66 vertically spaced from the mounting rod 64. The engagement between the flanges 63 and 65 and the mounting rods 64 and 66 securely mount the display 21*c* to the wall. Turning to FIG. 8, mounting bracket 51*d* has a plurality of apertures 70 formed therein. Screws 71 or other fastening means are inserted through the apertures 70 to affix the display 21*d* to the wall 52*d*. FIG. 9 shows a further modification of the display 21*e* in which an adaptor plate 73 has been secured to the mounting bracket 51*e*. With the adaptor plate 73, the display 21*e* may be conveniently mounted to a rack, a horizontal support rod or the like for displaying the skate 11.

Turning to FIG. 10, the display 21*f* may also be positioned on a counter, shelf, desk or other horizontal surface. The display 21*f* has an adapter plate 73*f* mounted to the mounting bracket 51*f*. The flap 59*f* and the adaptor plate 73*f* define a pair of legs depending from the support plate 22*f* to provide a stable display stand 21*f* for supporting the skate 11 in a substantially upright position. As shown in FIG. 10, the retainer 23*f* is provided by an upturned portion of the support plate 22*f*. The slot 47*f* extends through the upturned portion, providing the retainer 23*f* with a U-shaped configuration shaped to engage the roller 16. With the adapter plate 73*f* of the modification shown in FIG. 10, the display 21*f* may be conveniently supported on a horizontal surface or, if desired, the adaptor plate 73 may be removed and the display 21*f* mounted to a wall, enhancing the versatility of the display. In other embodiments, the mounting bracket 51*f* may be omitted and the support plate 22*f* may be formed with legs for supporting the display on a horizontal surface.

In the previously described embodiments, the support plate laterally supports the roller positioned in the elongated slot. FIG. 11 shows a modified display apparatus 21*g* in which the elongated slot has been omitted from the support plate 22*g*. The skate 11 is supported on the support plate 22*g* with the front roller 16 engaged by the retainer 23*g*. The loop 24*g* of the retainer extends around the upper portion of the roller 16 to support the skate in a substantially upright position. FIG. 12 shows another modified display apparatus 21*h* having a solid support plate 22*h*. One of the rollers 16 is supported on the support plate 22*h* and engaged by the loop 24*h* of the retainer 23*h*. The retainer 23*h* retains the skate 11 is an upright position suspended from the support plate 22*h*.

Turning to FIGS. 13 and 14, display 21*i* has a vertical retainer 23*i* positioned adjacent the slot 47*i*. When the skate 11 is supported on the display 21*i*, the retainer 23*i* is positioned within the channel-shaped frame 14 between two of the rollers 16. The retainer 23*i* engages the front of the inner roller 16 and the inner surfaces of the frame 14 to retain the skate 11 on the display and support the skate in a substantially upright position. In the modification shown in FIG. 13, the retainer 23*i* is generally rectangular in shape. However, it should be understood that the retainer 23*i* may be formed with other shapes. Moreover, if desired, the retainer 23*i* may be formed with a loop which engages the upper portions of the roller as in the previous modifications.

Except as set forth above, the modifications of FIGS. 4, 5–6, 7, 8, 9, 10, 11, 12 and 13–14 resemble those of the preceding modifications and the same reference numbers followed by the subscripts *a–i*, respectively, are used to designate corresponding parts.

As is apparent from the foregoing, the present invention provides a display apparatus for securely supporting and displaying in-line skates. The skates may be easily placed on and removed from the display by the merchant or a potential consumer. The retainer securely retains the skate on the bracket and is shaped to engage at least one of the front or rear wheels. The display apparatus may be formed with any of the mounting brackets shown in the Figures or with a mounting bracket having other securement means for mounting the display apparatus to a wall. The display apparatus may be formed with an elongated slot so that the support plate provides lateral support for the skate roller. Alternatively, the slot may be omitted and the skate supported in an upright position entirely by the retainer. Although the skate is preferably supported in an upright position, it is to be understood that the skate supported by the display may also have other orientations.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. In combination, an in-line skate and a display apparatus for supporting said in-line skate, said in-line skate comprising a boot, a frame depending from said boot having an inverted channel and a plurality of rollers rotatably mounted at spaced intervals to said frame with said rollers being positioned in said channel and extending below said frame, said display apparatus comprising:

a support member, and retaining means for retaining said skate in a substantially upright position, said retaining means having a pair of retaining arms extending upwardly from said support member, said retaining arms engaging opposite sides of at least one of said rollers to retain said skate in a substantially upright position.

2. The combination of claim 1 in which said support member has a slot shaped to receive at least one of said rollers, said retaining means being positioned adjacent said slot.

3. The combination of claim 2 in which said support member comprises a support plate having an edge, said slot extending inwardly through said support plate from said edge.

4. The combination of claim 1 in which said retaining means engages at least one of said rollers proximate a first end of said skate and said support member has an upward slanted portion opposite said retaining means for supporting a second end of said skate at an elevated position relative to said first end of said skate.

5. The combination in claim 1 in which said retaining means has a connecting portion extending between said retaining arms, said retaining arms and said connecting portion defining a U-shaped loop shaped to engage an upper portion of said at least one of said rollers to retain said skate in a substantially upright position.

6. The combination of claim 5 in which said support member has a slot extending inward from an edge thereof, said slot being shaped to receive at least one of said rollers, said loop extending inward and upward from said edge of said support member adjacent said slot.

7. The combination of claim 1 in which said support member is shaped and said retaining means is positioned to support said skate on said display apparatus with the center of gravity of said skate located vertically above said support member.

8. The combination of claim 1 in which said retaining means is configured for engaging said at least one roller to detachably secure said skate to said display apparatus with said skate suspended from said support member.

9. The combination of claim 1 which further comprises a mounting bracket on said support member for mounting said support member to a wall.

10. The combination of claim 9 in which said mounting bracket is positioned at an angle relative to a longitudinal axis of said retaining means to retain said skate at an angle relative to said wall when said skate is supported on said display apparatus.

11. The combination of claim 1 in which said support member has at least one downward extending leg portion for supporting said display on a horizontal surface.

12. In combination, a display apparatus for supporting an in-line skate and an in-line skate, said in-line skate comprising a boot, a frame depending from said boot and a plurality of rollers rotatably mounted at spaced intervals to said frame and extending below said frame, said display apparatus comprising:

a support member mountable to a wall, said support member having an upper surface, and retaining means mounted to said support member, said retaining means having a U-shaped loop extending upwardly from said upper surface of said support member and engaging an upper portion of at least one of said rollers to removably retain said skate on said support member.

13. The combination of claim 12 in which said support member has an elongated slot formed in said support member adjacent said loop, said slot being dimensioned to receive said at least one of said rollers.

14. The combination of claim 12 in which said loop has first and second inclined arms extending upward from said support member, said inclined arms being positioned to engage opposite sides of said at least one of said rollers.

15. The combination of claim 14 in which said loop has a connecting portion interconnecting said inclined arms and positioned to extend across an upper portion of said at least one of said rollers.

16. The combination of claim 12 in which said retaining means has a pair of leg portions extending inwardly from said loop, said leg portions being mounted to said support member.

17. The combination of claim 12 in which said support member is shaped and dimensioned and said loop is positioned to support said skate on said display apparatus with said skate is positioned with the center of gravity of said skate located above said support member.

18. The combination of claim 12 in which said retaining means is configured for engaging said at least one roller to detachably secure said skate to said display apparatus with said skate suspended from said support member.

19. The combination of claim 12 in which said support member is mountable to a wall.

20. The combination of claim 12 in which said support member has at least one downward extending leg portion for supporting said display on a horizontal surface.

21. In combination, an in-line skate and a display apparatus for supporting said in-line skate, said in-line skate comprising a boot, a frame depending from said boot having an inverted channel and a plurality of rollers rotatably mounted at spaced intervals to said frame with said rollers being positioned in said channel and extending below said frame, said display apparatus comprising:

a support member, and retaining means for retaining said skate in a substantially upright position, said retaining means having a pair of retaining arms extending upwardly from said support member, said retaining arms fitting within said channel and engaging said frame to retain said skate in a substantially upright position.

22. The combination of claim 21 in which said support member has a slot shaped to receive at least one of said rollers, said retaining means being positioned adjacent said slot.

23. The combination of claim 21 which further comprises a mounting bracket on said support member for mounting said support member to a wall.

24. The display apparatus of claim 21 in which said support member has at least one downward extending leg portion for supporting said display on a horizontal surface.

* * * * *